US009850630B2

(12) United States Patent
Annan et al.

(10) Patent No.: US 9,850,630 B2
(45) Date of Patent: Dec. 26, 2017

(54) CABLE ANCHORAGE WITH BEDDING MATERIAL

(71) Applicant: VSL INTERNATIONAL AG, Koniz (CH)

(72) Inventors: Rachid Annan, Rapperswil (CH); Adrian Gnagi, Bern (CH)

(73) Assignee: VSL International AG (CH)

( * ) Notice: Subject to any disclaimer, the term of this patent is extended or adjusted under 35 U.S.C. 154(b) by 0 days.

(21) Appl. No.: 14/893,476

(22) PCT Filed: May 30, 2014

(86) PCT No.: PCT/EP2014/061288
§ 371 (c)(1),
(2) Date: Nov. 23, 2015

(87) PCT Pub. No.: WO2014/191565
PCT Pub. Date: Dec. 4, 2014

(65) Prior Publication Data

US 2016/0115658 A1 Apr. 28, 2016

(30) Foreign Application Priority Data

May 31, 2013 (GB) ..... 1309791.0

(51) Int. Cl.
*E01D 19/00* (2006.01)
*E01D 19/14* (2006.01)
(Continued)

(52) U.S. Cl.
CPC ..... *E01D 19/14* (2013.01); *E01D 19/16* (2013.01); *E01D 21/00* (2013.01); *E04C 5/12* (2013.01); *E04C 5/122* (2013.01)

(58) Field of Classification Search
CPC ..... E01D 19/14; E01D 19/16; E01D 21/00; E04C 5/122; E04C 5/12
(Continued)

(56) References Cited

U.S. PATENT DOCUMENTS 3,475,777 A * 11/1969 Robinson ..... E01D 19/14 14/21
3,548,432 A * 12/1970 Durkee ..... E01D 19/14 14/18
(Continued)

FOREIGN PATENT DOCUMENTS

EP 0323285 A1 7/1989
EP 0428304 A1 5/1991
(Continued)

OTHER PUBLICATIONS

International Search Report for PCT/EP2014/061288 dated Aug. 21, 2014; 5 pages.

*Primary Examiner* — Raymond W Addie
(74) *Attorney, Agent, or Firm* — Blank Rome LLP

(57) ABSTRACT

A cable anchorage anchors a cable, for example a stay cable having multiple strands (50), against a longitudinal tension force. The anchor block (11) of the anchorage includes multiple channels, through which the strands (50) are individually threaded. Once in position and tensioned, the space around the strands (50) in the anchor block (11) is injected with a liquid, such as a polyurethane, which subsequently sets to form a tough elastic bedding material (51) within the anchor block (11). The elastic bedding material (51) has a durometer at 23° C. in the range 10 to 70 Shore, so as to form bedding cushion extending substantially around the strand (50) in the strand-channel (6) along a bedding region (54) of strand-channel (6), the bedding cushion reducing the bend-
(Continued)

ing stresses in the strand (50) by absorbing bending stresses along the bedding region (54).

15 Claims, 5 Drawing Sheets

(51) Int. Cl.
*E01D 19/16* (2006.01)
*E04C 5/12* (2006.01)
*E01D 21/00* (2006.01)

(58) Field of Classification Search
USPC ..... 14/21, 22, 77.1
See application file for complete search history.

(56) References Cited

U.S. PATENT DOCUMENTS 4,117,582 A * 10/1978 Borelly ..... B21C 47/02 14/22
4,557,007 A * 12/1985 Daiguji ..... E01D 19/14 14/21
4,633,540 A * 1/1987 Jungwirth ..... E04C 5/122 14/21
4,648,146 A * 3/1987 Nutzel ..... E01D 19/14 14/21
6,292,967 B1 * 9/2001 Tabatabai ..... F16F 7/104 14/22
6,748,708 B1 * 6/2004 Fuzier ..... E01D 19/14 24/122.6
6,796,745 B2 * 9/2004 Kulchin ..... E02D 5/76 405/259.1
7,124,460 B2 * 10/2006 Lecinq ..... E01D 19/14 14/21
2002/0108329 A1 * 8/2002 Bournand ..... E01D 19/14 52/223.13
2003/0051638 A1 * 3/2003 Pomeroy ..... C04B 28/04 106/712
2009/0226691 A1 * 9/2009 Mankame ..... D07B 1/0673 428/222

FOREIGN PATENT DOCUMENTS

EP 1181422 A1 2/2002
EP 1227200 A1 7/2002
WO WO-00/75453 A1 12/2000
WO WO-2011/116828 A1 9/2011
WO WO-2012/079625 A1 6/2012
WO WO-2012/140463 A1 10/2012

* cited by examiner

CABLE ANCHORAGE WITH BEDDING MATERIAL

RELATED APPLICATIONS

This application is a national phase of PCT/EP2014/061288, filed on May 30, 2014, which claims the benefit of Great Britain Application No. GB1309791.0, filed on May 31, 2013. The entire contents of those applications are incorporated herein by reference.

The present invention relates to the field of cable anchorages such as may be used, for example, for anchoring stay cables. In particular, but not exclusively, the invention relates to the anchoring of cables comprising multiple strands which are held under tension and which are subject to static and/or dynamic deflection.

BACKGROUND OF THE INVENTION

Stay cables may be used for supporting bridge decks, for example, and may typically be held in tension between an upper anchorage, secured to a tower of the bridge, and a lower anchorage, secured to the bridge deck. A cable may comprise dozens or scores of strands, with each strand comprising multiple (eg 7) steel wires. Each strand is typically retained individually in each anchorage by tapered conical wedges, seated in a conical hole in an anchor block. Tensioning of the strands can be performed from either end, for example using hydraulic jacks. When in use, cables may be subjected to lateral, axial and/or torsional forces due to vibration or other movement of the bridge deck (which may arise due to wind, or to the passing of heavy traffic, for example). As a result of the above effects, the cables may experience lateral, axial and/or torsional oscillatory motion. This oscillatory motion may be in the cable as a whole (ie the strands of the cable moving together), or it may be in individual strands, or both. Other cables, such as prestressing cables, may also be subject to static and/or dynamic deflection at or near the end anchorages.

Such oscillatory movements in a cable, strand or wire may result in damages of the individual strands and of the anchorage, due to repeated impacts between the strand and strand channel, and due to bending stress notably where the strands are anchored. This friction between strand and strand channel can, over time, cause fretting, work-hardening or other damage to the cable and/or to the anchorages, thereby significantly reducing the serviceable life of the cable and/or anchorage, and greatly increasing the maintenance and monitoring effort required. Replacing damaged strands is a time-consuming and expensive operation and usually entails significant interruption of traffic in the case of a bridge. This is particularly so if all of the strands in a cable must be replaced at once.

PRIOR ART

To at least partially overcome this problem, a prior art solution consists in using an individual deviator element at the mouth of the anchorage where each strand emerges. Such a channel exit with a curved surface is disclosed for example in European patent EP1181422, in which the mouth of each anchorage channel is shaped as a flared opening having a constant radius of curvature. The deviator element in this patent offers a curved surface, trumpet shaped, against which each strand can press when it experiences lateral deviation, thereby extending the length of the contact region between the strand and the anchorage where lateral forces due to bending are transferred between the strand and the anchorage, and reducing localized damage which might otherwise occur as a result of persistent localized fretting of the strand against an abrupt edge. This solution increases the amount of deviation of the cable which can be tolerated at the exit of the anchorage (and hence increase the maximum span of cable which can be anchored). Such a curved surface reduces the surface of contact between the strand and the wall of the strand receiving channel at the anchorage end turned towards the running part of the strand. Nevertheless this solution cannot accommodate important strand deviations, requires a supplemental trumpet shaped part or an adaptation of the construction of the anchorage's exit, which induce supplemental costs. Also due to the enlarged possible deviation of each strand, the overall dimension of the anchorage is considerably increased.

The magnitude of the angular deviations which can be tolerated by the anchorages also imposes significant restrictions on the design of the structure which is being supported or tensioned. For example, longer cable spans, with lighter and more flexible deck structures, result in greater angular deviations at the end anchorages. The current trend towards more flexible structures therefore means that the anchorages must be able to cope with greater angular deviations of the cables. A bridge deck supported centrally by a single planar "fan" of stay cables, for example, undergoes significantly greater rotation of the deck, and hence engenders significantly more angular deviation in the stay cables at the anchorages than a bridge deck suspended from two lateral planes of stay cables.

In such prior art existing anchorage, the deviator elements or curved guide surfaces are sited where the strands exit from the anchorage, on the assumption that this is where the deflections in the strand cause the most damage to the strand. However, as will be discussed later, the combination of the bending stresses in the cable and the lateral clamping stresses applied by the wedges, means that it is the anchoring (clamping) region, not the exit region, which is often the most critical location for the fatigue performance of the cable and the individual strands.

The length and curvature of the curved surfaces must be selected to be suitable for the anticipated angle of deflection in the strands. Larger deflections require longer curved surfaces. However, the proximity of the strands to each other in the anchorage dictates that there is a maximum practicable length of the curved surfaces, and/or a minimum radius of curvature, thus limiting the maximum deflection angle which can be specified for the anchorage.

Moreover, in such prior art existing anchorages, the required minimum length of the deviator elements or curved guide surfaces results in a minimum axial length of the anchorages which is longer than the minimum structural depth required to support the anchored cable forces. They therefore imply additional costs to the total cost of the structure manufacturing and/or repairing.

It is an object of the present invention to overcome one or more of the disadvantages of prior art anchorages.

In particular, an aim of the invention is to provide another means for reducing the damages to the cable strands and to the anchorage caused by static deviations and possible oscillatory movements of the cable, in particular at the exit of the anchorage.

Another aim of the invention is to provide an anchorage which requires smaller dimensions and distances between strands than the prior art anchorages.

Those aims are achieved by a method of anchoring a strand subject to static and dynamic deflection in a cable anchorage, the cable anchorage comprising an anchor block, a strand channel through the anchor block, extending between an anchoring end and an exit end, and a strand-anchoring conical wedge at said anchoring end of the anchor block, for transferring an axial tension load in the strand to the anchor block, the length of the strand channel being less than 10 times the smallest diameter of the strand channel, the method comprising: a filling step, in which a space surrounding the strand in the strand-channel is at least partially filled with a flexural and/or elastic bedding material having a durometer at 23° C. in the range 10 to 70 Shore, so as to form a bedding cushion extending substantially around the strand in the strand-channel and axially along a bedding region of the axial length of the strand-channel.

Those aims are also achieved by a cable anchorage comprising: an anchor block, a strand channel through the anchor block, extending between an anchoring end and an exit end, for accommodating a strand subject to static deflection in the strand channel, the length of the strand channel being less than 10 times the smallest diameter of the strand channel, and a strand-anchoring conical wedge at said anchoring end of the anchor block, for transferring an axial tension load in the strand to the anchor block, in which a bedding cushion extends substantially around the strand in the strand-channel and axially along a bedding region of the axial length of the strand-channel, the bedding cushion comprising a flexural and/or elastic bedding material having a durometer at 23° C. in the range 10 to 70 Shore.

The presence of an adapted elastic or flexural bedding cushion between each strand and the inner wall of each corresponding individual channel of the anchor block ensures, in addition to protecting the strand against corrosion, that any bending stresses which are still present in the strand where the strand enters the anchor block are quickly and efficiently transferred to the anchor block by means of "elastic bedding", as will be described in more detail below. Thus it is possible virtually to eliminate bending stresses in the strand at the point where the strand enters the wedge, and thereby protect the strand from damage under the influence of static or dynamic deviations.

Such an elastic bedding material forming a bedding cushion in the strand-channel, between the strand and the anchor block, further damps the vibrations of the strand in the strand channel by absorbing at least partially the vibrational energy of the portion of the strand located in the strand-channel. Therefore the solution induces also a reduction of the oscillatory movements of the strand.

Another advantage of this anchorage is that it can be made shorter than those of the prior art, and accommodate greater deflection angles of the cable or strand(s).

The use of such a bedding cushion can be implemented for strands which are already in services, either during an adaptation procedure of prior art existing anchorages (total or partial replacement of the existing less or not performant bedding material, such as grease). Also, the use of a bedding cushion according to the present invention can be combined with deviator elements or curved guide surfaces of prior art existing anchorages.

The invention also envisages a construction comprising one or more cable anchorages as previously mentioned.

Reference is made throughout this application to the example of anchorages for stay cables comprising steel strands. However, it should be understood that the invention may be applied to anchorages for any type of cables, eg stay cable, hangers, external tendons etc, comprising rope, wire or strands etc which are subject to deviation at or near the anchorage. Such cables etc are often made of steel, but the invention presented here is not limited to steel cables, and may be applied to cables made of other materials, such as carbon or other structural fibres. The terms "cable" and "strand" should thus be interpreted as covering any kind of flexible longitudinal tension element which may be subject to angular deviation. The invention described here is thus susceptible of application in all types of structure in which such cables are required to be anchored.

Note also that the terms "deviation" and "deflection" are used interchangeably in this application.

The term "axial" is used to refer to a direction parallel to the longitudinal axis of the anchorage and/or to the cable. Similarly, references to "length" in this application refer to dimensions measured along the axial direction.

BRIEF DESCRIPTION OF THE DRAWINGS

The invention will now be described in more detail with reference to the attached drawings, in which.

DETAILED DESCRIPTION OF THE INVENTION

Figure 1:
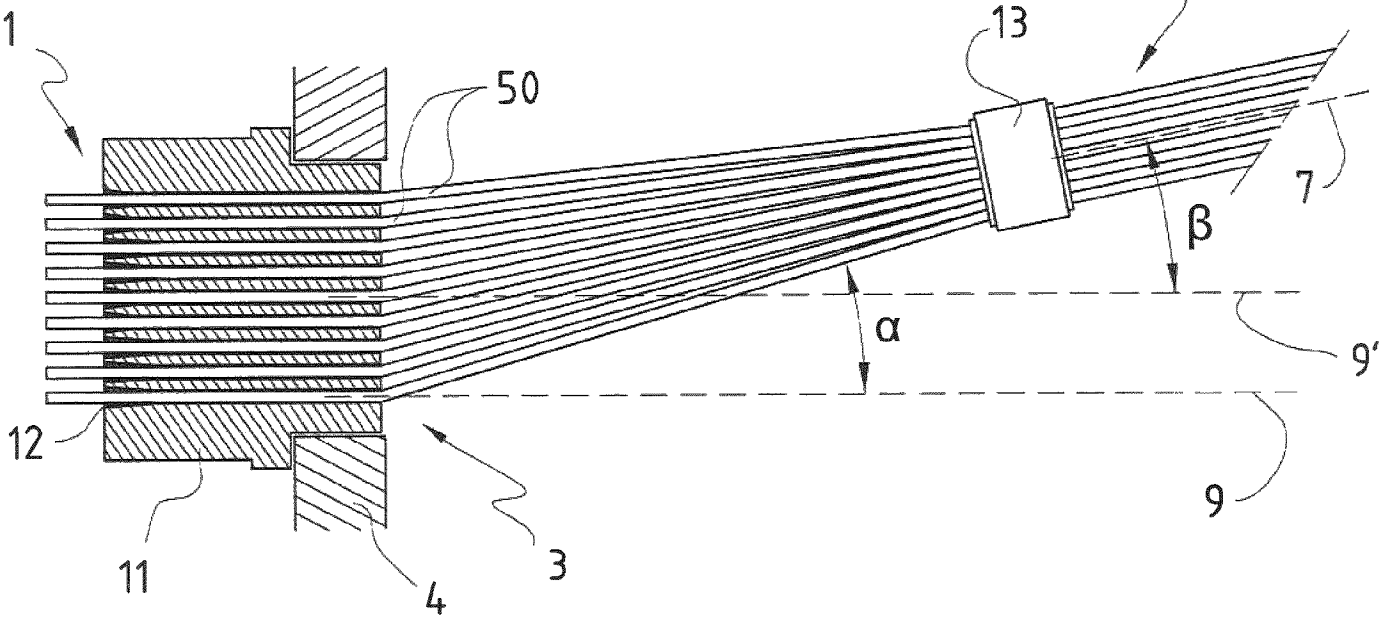
FIG. 1 shows in schematic form a cross-sectional view along a longitudinal plane through an anchorage and a multi-strand cable.

The figures are provided for illustrative purposes only, as an aid to understanding certain principles underlying the invention, and they should not be taken as limiting the scope of protection sought. Where the same reference numerals are used in different figures, these are intended to refer to the same or equivalent features. However, the use of different numerals is not necessarily intended to indicate any particular difference between the features to which they refer.

As shown in FIG. 1, a cable 8 may comprise individual strands 50 which are anchored individually in an anchor block 11 of an anchorage. The anchor block typically comprises a solid block of a metal such as steel, and is designed to hold the cable 8 in tension against a part of the structure, 4, being prestressed or supported. The strands 50 must be separated from each other in the anchor block 11 in order to allow space for the anchoring means (eg conical wedges 12 at the anchoring end 1 of the anchor block 11), and the separated strands 50 exit from the anchor block 11 at the exit end 3 of the anchor block 11 and may be gathered together by a collar 13, also referred to as a deviator, so that the strands are bundled closely together with along the main running portion of the cable 8, thereby minimising wind-exposure (in the case of a bridge stay cable). In the illustrated example, each strand is anchored by conical wedge sections 12 which fit around the strand, gripping it in compression in corresponding conical bores when the strand is under tension.

The region 56 of the anchorage in which the strand is gripped, or anchored, is referred to in the application as the gripping or anchoring region, and the gripping or anchoring can be realized by conical wedges 12, as mentioned, or by button heads, compression fittings or any other suitable method. It is in this gripping region that the strand is particularly vulnerable to damage when the cable is subject to deflection, because of the combination of axial stress, bending stress and transverse clamping stress. Each strand 50 is therefore individually contained in one dedicated strand-channel 6.

FIG. 1 also shows, greatly exaggerated, how the cable 8, and consequently the individual wires or strands 50, may be subject to a lateral deviation while under tension and anchored in anchor block 11. The principal longitudinal axis 7 of the cable 8 may undergo an instantaneous angle of deflection β at or near the exit of the anchorage of as much as 45 mrad or more from the longitudinal axis 9' of the anchorage, for example, while the corresponding maximum deviation a of an individual strand 50 may be as much as 75 mrad from the longitudinal axis 9 of the corresponding strand-channel, for example, depending on the strand's position in the cable 8.

The strand deviation typically has a horizontal component and a vertical component, for example as a result of resonance in the cable or external forces such as a wind force, or as a result of a twisting in a part of the structure.

As discussed earlier, prior art anchorages have focused on the design of the exit region of the anchorage, where the strands exit into free air.

The assumption was that this was where potential damage and failure was most likely to occur as a result of combined axial and bending stresses in the strands. However, the applicant has determined that, particularly in compact anchorages, failure is in fact more likely to occur at the anchoring region 56 itself, in the region where the strand is gripped. The strand is more vulnerable to failure where it is gripped by anchor wedges, for example, because of the significant lateral compression forces in the strand. There is typically also some deformation of the surface of the strand at the anchoring region 56, causing notch effects, due for example to the gripping profile, such as ribbing, on the inner surface of the wedges. Other types of anchoring may be accompanied by other sources of vulnerability to failure.

Figures 2A, 2B, 2C, 2D:
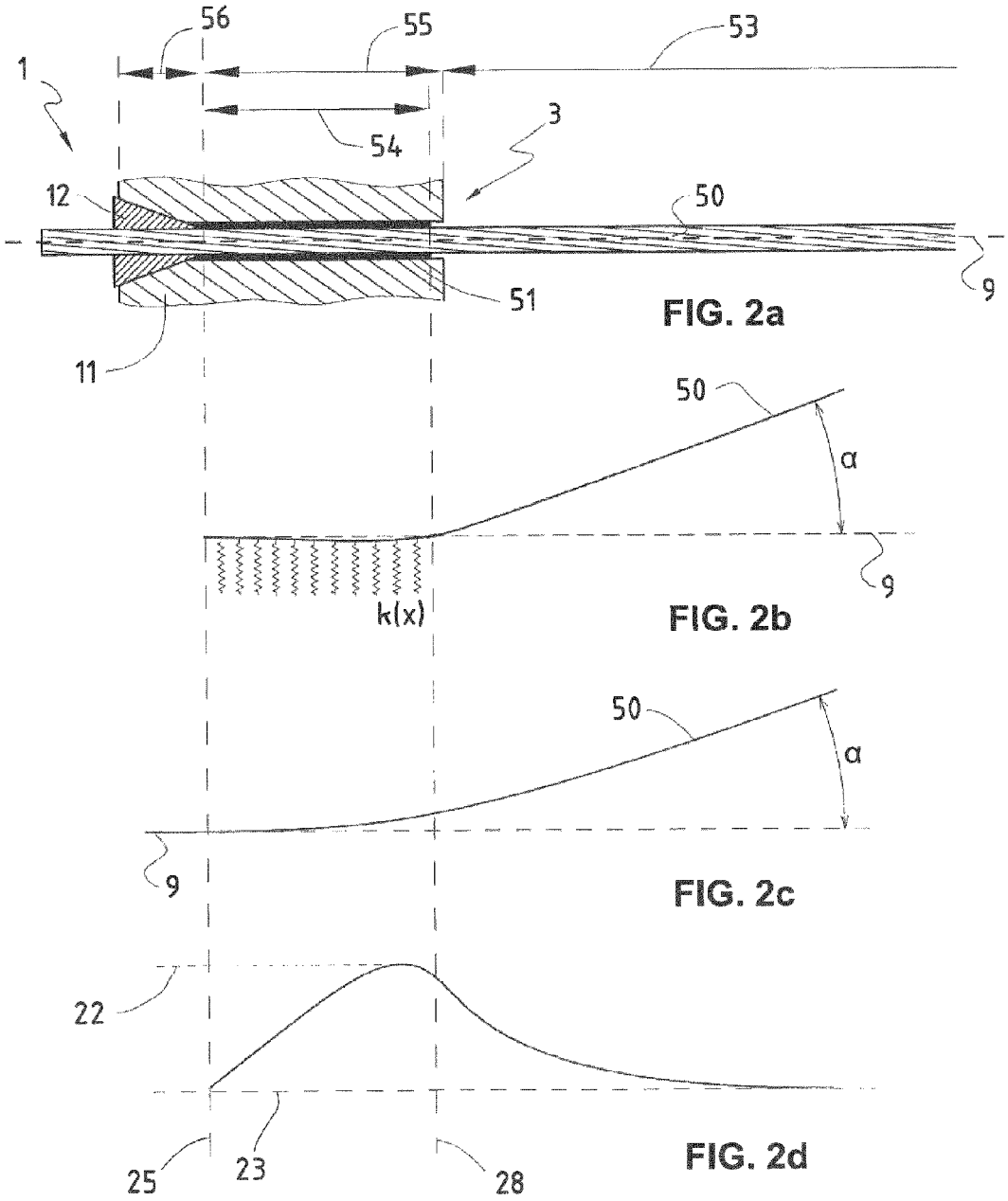
FIG. 2*a* illustrates schematically a single strand held in an anchor block of an anchorage according to the invention.
FIG. 2*b* illustrates schematically the compressive stiffness of the bedding cushion in the anchorage of FIG. 2*a*.
FIG. 2*c* shows, in greatly exaggerated, schematic form, a transverse deflection of the strand of FIG. 2*a*.
FIG. 2*d* shows schematically the bending stresses in the strand of FIG. 2*a* when subjected to a deflection such as that shown in FIG. 2*c*.

In order to stop bending stresses from reaching the gripping region (anchoring region), the invention now proposes to use a flexural and/or elastic bedding material 51, preferably having a defined stiffness and hardness, located in the space between the strand 50 and the inner wall of the channel, as indicated schematically in FIG. 2*a*. The bedding material 51 forms a bedding cushion which extends along a bedding region 54 of the axial length 55 of the strand channel 6. There is therefore one bedding cushion for each strand 50, said bedding cushion being made of said bedding material 51. The bedding material 51 may comprise a solid polymeric or elastomeric material or polymeric elastomer, notably a visco elastic polymer, such as polyurethane, epoxy-polyurethane, epoxy polymer or reticulated epoxy resin, for example, and serves to transfer the bending stresses to the surrounding, substantially rigid, anchorage structure, using an effect known as "elastic bedding". The concept of elastic bedding was originally developed as a numerical analysis method for modelling flexural behaviour of structural members supported on soil or other types of ground material, in order that the flexibility of the ground could be taken into account when designing structures in or on the ground. Similar mathematical calculations can be carried out to determine the elastic bedding properties (for example the compressive stiffness) which are necessary in the bedding material 51 to ensure that the lateral bending stresses in the strand 50 are absorbed by the anchorage in a bedding region 54 which is as short as is practicable. Note that, in the context of the present application, the term "elastic bedding" is not limited to bedding which has a classical linear elasticity, but may also include bedding which has non-linear deformation behaviour. The compressive stiffness of the bedding material can be predetermined by selecting bedding material having a particular Shore value (durometer), for example, and by taking into account the dimensions of the space occupied by the bedding material between the strand and the substantially rigid material of the surrounding anchorage (eg the steel of anchor block 11), at least over the region 54 of the channel (referred to as the bedding region) over which the elastic bedding is required to be effective. The free-running or main part of the strand 50 is indicated in the figures by reference 53.

FIG. 2*b* illustrates the compressive stiffness of elastic bedding (also referred to as the amount of lateral support), indicated as a function k(x), which is offered by the presence of the bedding material 51 to resist the lateral bending stresses which arise as a result of a deflection of the free strand by an angle α, where x represents a distance along a longitudinal axis 9 parallel to the channels of the anchorage. As shown on FIG. 2*b*, the bedding material 51 acts like springs placed in series along the bedding region 54 between the strand 50 and the strand-channel 6, and forming a bedding cushion acting like a flexible support to limit stress and like a damper for dynamic load.

FIG. 2*c* illustrates, greatly exaggerated in the transverse direction, the curvature of the strand 50 of FIG. 2*a* when it is deflected from its longitudinal axis 9 by an angle α. The strand 50 bends as it exits from the mouth region 3 of the anchor block 11. Existing solutions aim to control the bending stress in the anchorage by acting at the exit of the anchorage by providing either a bell-mouth or a flexible guiding. By contrast, it may be a feature of an anchorage of the invention to control the bending stress by acting along most of the bedding region by providing a non-rigid bedding cushion along the length of the bedding region. This provides a more efficient reduction of bending stress in the strand, and results in improved control of bedding stress, while reducing the distance between the wedges and the exit of the anchorage. Whereas prior art anchorages were focused on absorbing the bending stress at the channel exit, and were therefore designed to mitigate a pivot effect in the strand, for example by offering a curved transition surface at the exit to the anchorage, the method and anchorage of the present invention focus rather on reducing the bending effects in the strand at the gripping region 56, and thus offers an alternative solution: the bending is countered within the strand channel by means of the compressive stiffness of the bedding cushion 51 in the bedding region 54 of the anchor block 11. By implementing the countermeasures (bedding) against the bending stresses in the anchor block 11 itself, the overall length of the anchorage can be greatly reduced. Furthermore, because elastic bedding is a highly effective countermeasure for absorbing bending stresses, the method and anchorage of the invention can be used in situations where the angle of deviation of the strand/cable is significantly greater than has been possible with prior art anchorages of similar length. The inventive anchorage may be used, for example, in situations where the deviation angle is as much as 60 mrad (static)+/−15 mrad dynamic, or even more. This capacity for accommodating a much greater deviation angle also means that the method and anchorage of the invention can be used for anchoring cables which support significantly longer spans than was hitherto practicable in the prior art.

FIG. 2*d* shows the bending stresses in the strand 50 of FIG. 2*a* when it is subjected to a deflection of angle a as shown in FIG. 2*c*. The peak value 22 of the bending stress occurs somewhere near the exit 3 of the anchor channel. However, as can also be seen from FIG. 2*d*, the elastic bedding effect provided by the bedding cushion 51 over the bedding region 54 ensures that the bending stresses in the strand 50 are reduced, in this example almost linearly, to a very small value 23, approaching zero, at the anchoring end of the bedding region 54.

In prior art anchorages having converging strand channels and an elastic wall section at the channel exit, such as the anchorage described in W02012079625, the bending stress due to deflection in the strand does not diminish as evenly, or as quickly, or to such a low value, as can be achieved with an anchorage according to the present invention.

In an anchorage which uses a curved/flared deviator element at the mouth of the strand channel, such as the anchorages described in EP1227200 and EP1181422, for example, the bending stress in the strand is still significant at the point where the strand enters the gripping region 56. Such anchorages must thus be made significantly longer in order for the deviator element to adequately control the bending stresses at the gripping region 56.

We now turn to examples of how the bedding cushion 51 of the invention may be provided. The bedding material can be introduced into the space around the strand inside the channel by injection, for example. Thus, a liquid polyurethane compound can be injected through or between the anchor wedges 12, for example, so that it substantially fills the space between the strand 50 and the channel wall over the entire length 55, or at least a majority of the length, of the channel in the anchor block 11. The type of polyurethane can be selected so that it flows easily when being injected, and the injection process can be further assisted by means of a suction (vacuum) opening, or at least a vent, through which the air displaced by the injected liquid can escape or be sucked out of the space around the strand 50 in the channel. The liquid is chosen so that, once injected, it then hardens to the required durometer, in accordance with the elastic bedding calculations.

Alternatively, the bedding material can be introduced in solid form. This can be achieved by introducing it in the form of particulate or fibrous material, for example, such as a powder or beads or fibres. If required in order to achieve the required elastic and/or flexural properties, a further process, such as sintering, may then be performed on the particulate material.

The bedding material may take the form of a coating or sleeve, fitted or applied to the inside surface of the channel and/or to the outer surface of the strand 50, and dimensioned such that the coating or sleeve provides the required elastic bedding function between the strand 50 and the inner wall of the channel. Or, if the material of the channel wall or the strand sheath has suitable compressive stiffness and/or elastic properties, it may also form at least part of the bedding cushion 51. In that situation, the filling step comprises providing the bedding material 51 in the form of a coating or sleeve around the strand 50 in the bedding region 54 of the strand channel 6.

Alternatively, one or more of the above variants may be combined to give the desired elastic bedding effect. The bedding cushion 51 formed by the bedding material may completely fill the cavity between the strand 50 and the wall of the strand-channel 6. However, the desired elastic bedding effect can also be achieved even if a gap (not shown) separates the bedding cushion 51 from the wall of the strand-channel 6 and/or the strand 50.

The bedding material may advantageously also be selected for its corrosion-protection properties. Liquid polyurethane, which then hardens to a predetermined compressive stiffness, and which adheres well to the surfaces of the space it fills, is an example of such a bedding material which also serves to protect the strand from corrosion.

The introduction of the bedding material as a fluid or particulate material is advantageously carried out once the strands 50 have been tensioned, so that the bedding material can fill the space and assume a shape which will not then be significantly deformed by any further large movements of the strand. In this way, an optimum bedding is achieved between the strand 50 and the anchorage body.

The above description refers to a generalised description of how the invention can be implemented to shorten the length of the anchorage while still eliminating or substantially reducing the effects of bending stress at the anchoring region 56 of the anchorage. It has been shown that, with a seven wire strand, in which each wire is 5.25 mm diameter, the bending stress at the anchoring region 56 can be limited to less than 50 MPa (magnitude) by the use of a bedding region 54 which is less than 150 mm (eg between 90 mm and 150 mm) long, and using a bedding material (or a combination of bedding materials) having a compressive stiffness of between 50 and 250 MPa (preferably between 50 and 180 Mpa) and a durometer value of 10 to 70 Shore. Preferably the durometer value of in the bedding material 21 is in the range 10 to 30 Shore or even preferably in the range 15 to 25 Shore. Using the following relation between the hardness and the Young's modulus for elastomers:

$$E = \frac{0.0981(56 + 7.62336S)}{0.137505(254 - 2.54S)}$$

Where E is the Young's modulus in MPa and S is the ASTM D2240 type A hardness used as durometer, the bedding material 21 used for the invention has preferably a stiffness defined by its Young's modulus in the range 0.4 to 5.5 Mpa, and more preferably in the range 0.4 to 1.1 or even preferably in the range 0.6 to 0.9 Mpa Prior art anchorages were required to be between 10 and 20 times as long as the diameter of the strand being anchored in order to provide adequate bending control. The inventive techniques described here, however, permit an anchorage to have a channel length 55 which is less than ten times the diameter of the strand(s) being anchored.

An additional advantage of using an elastic bedding material of modest durometer, as described earlier, or an elastic bedding material which is separated from the strand by a gap, is that such a bedding cushion offers a low resistance to longitudinal movements of the strand. This means that, while the bedding cushion is sufficiently stiff to provide the desired elastic bedding function, it still has sufficiently low strength that the strand can be pulled out of the channel with relatively little force. For short anchorages, it is even possible to pull a strand out by hand. For longer anchorages, a small capacity jack or other device may be required to pull the strand through the anchorage.

Two example embodiments will now be described, which relate to two typical anchorages for a stay cable: a first, referred to as the "passive end" anchorage, and generally located at the less accessible end of the cable, which simply holds the strands at one end of the cable. The second, referred to as the "stressing end" anchorage, and generally located at the more accessible end of the cable, allows the strands to be pulled through its anchor block, for example by hydraulic jacks, until the strands are individually tensioned to the required tension.

The first embodiment will be described with reference to FIGS. 3 and 4, while the second embodiment is described with reference to the FIGS. 5 and 6.

Figure 3:
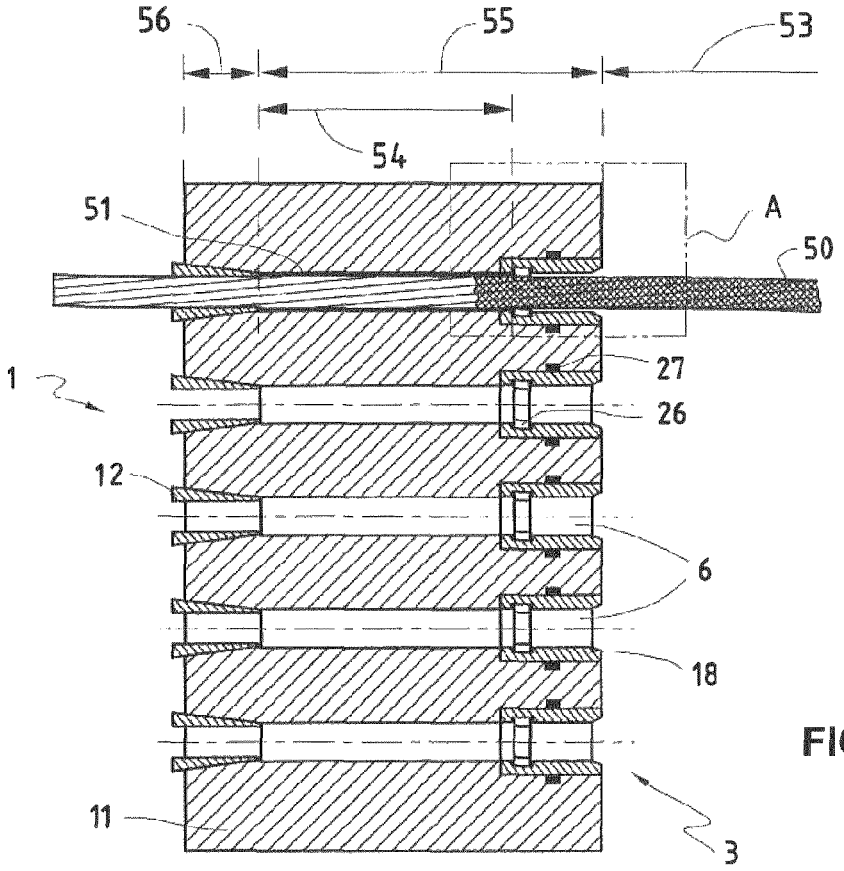
FIG. 3 shows, in schematic, cross-section al view, an anchorage according to a first embodiment of the invention.
Figure 4:
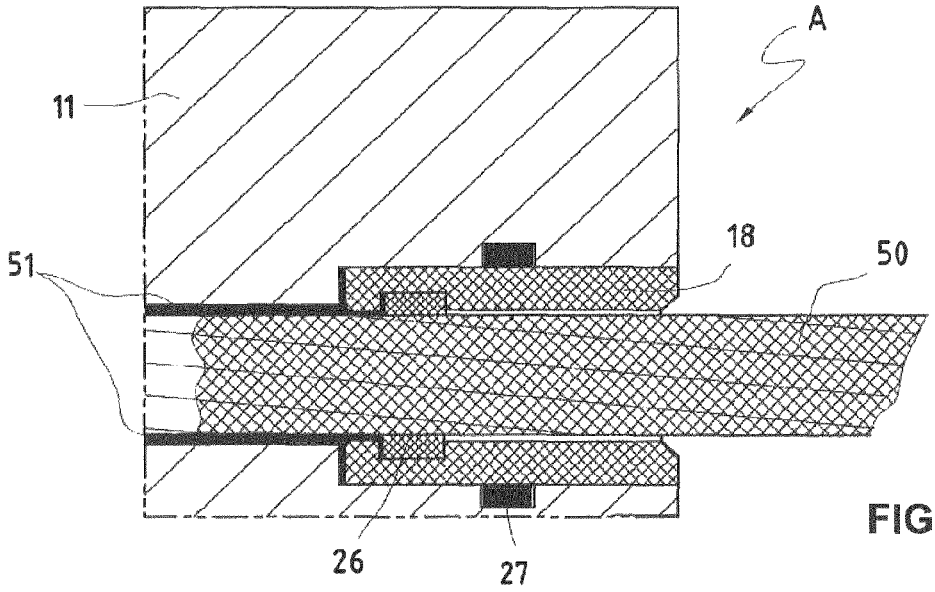
FIG. 4 shows an enlarged section (A) of the anchorage of FIG. 3.

FIGS. 3 and 4 depict an example of an anchorage which is suitable for the "passive end" application mentioned above. It comprises multiple channels, 6, formed through an anchor block 11 which may for example be a block of hard steel or other material suitable for bearing the large longitudinal tension forces. Strands 50 are held in place in the channels 6 by means of conical wedges 12. An orifice element 18 is located at the exit region of the anchorage, where the strand 50 emerges from the anchorage. The orifice element 18 may be a moulded plastic part, for example, and is provided with an inner seal 26, for providing a water-tight seal between the orifice element 18 and the strand 50, and an outer seal 27, for providing a water-tight seal between the orifice element 18 and the surrounding structure. Also, notably for an easier manufacturing, the orifice element 18 may be a two-piece part, the assembling of these two pieces defining a boundary at the location of a recess for accommodating the inner seal 26. For instance these two pieces are in plastic and welded before mounting in the anchorage so that said boundary is water tight. As shown on FIGS. 4 to 5, preferably, the seal 26 is disposed between the outer surface of the strand 50 and the inner surface of the strand-channel 6 at a first axial position along the strand-channel 6, in an annular or cylindrical recessed region of the inner wall of the channel 6, for preventing a transition of liquid between the said volume and an external region of the cable anchorage located towards the main running portion 8.

In this example of a passive end anchorage, it is advantageous for the anchorage to be as short as possible, and the bedding material 51 is thus provided with optimum compressive stiffness and hardness, and is preferably continuous and fills the entire space between the strand 50 and the surrounding anchor block 11.

Part of the strand 50 (heavily shaded) is sheathed, for example with a polymeric material. The inner seal 26, which is advantageously formed of an elastomeric material, therefore bears against the outer surface of the sheath.

The inner seal 26 not only prevents water ingress from the outside (right-hand side in FIGS. 3 and 4) of the anchorage, but can also serve as a barrier for defining the extent of the bedding material 51 if the bedding material 51 is injected as a liquid, for example. In this case, the liquid forming the bedding material 51 is contained in the channel defined by the strand-channel 6 (outer wall), the strand (inner wall) and by the inner seal 26 forming therefore a terminal plug. The combination of elastic seal 26 and flexural/elastic bedding material 51 results not only in a highly effective elastic bedding effect, as discussed above, but also as a highly-effective corrosion protection.

Thanks to the presence of the bedding material 51, the overall length of the anchorage shown in FIGS. 3 and 4 can be significantly reduced while ensuring low bending stresses at the gripping region of the strand.

Figure 5:
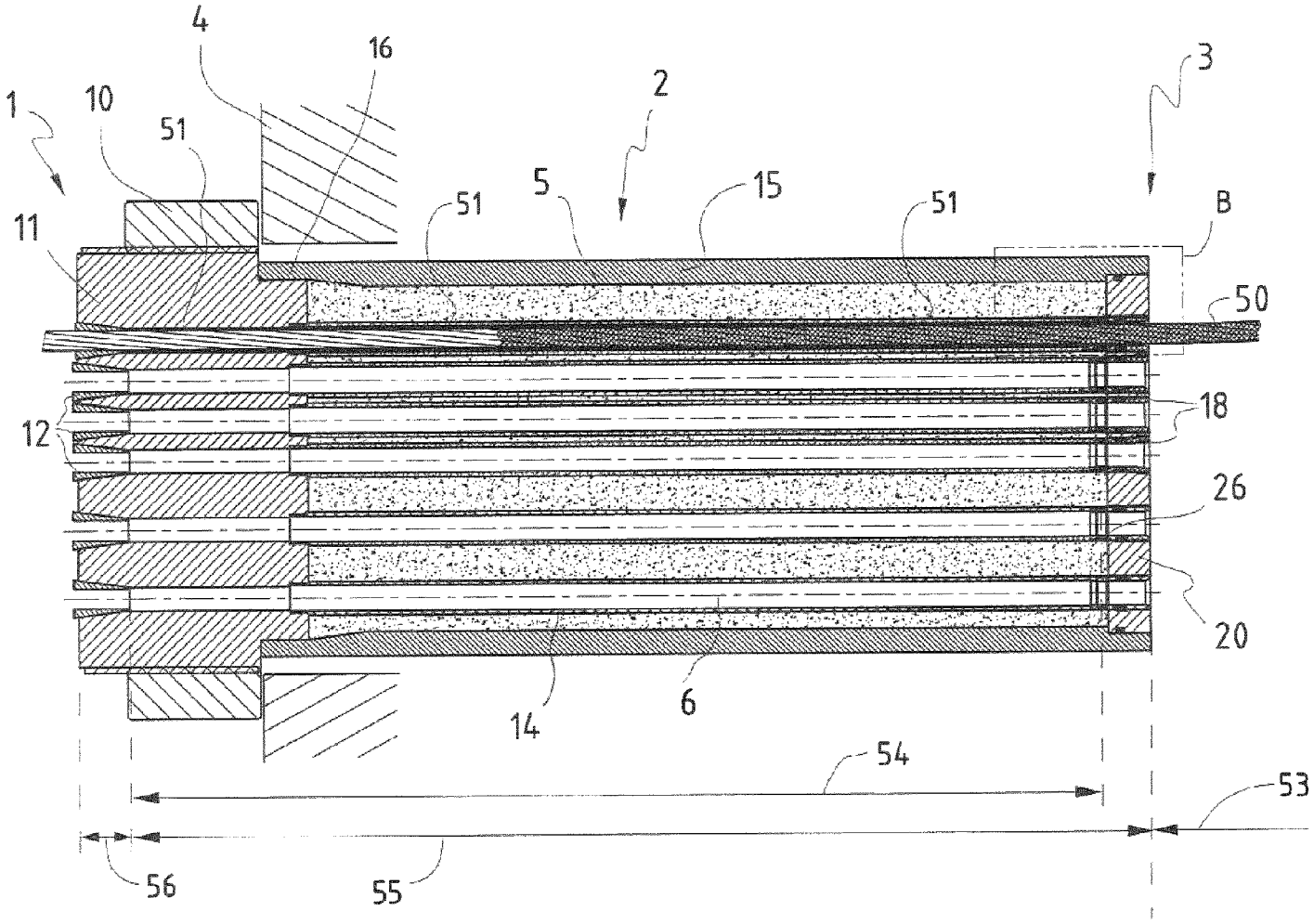
FIG. 5 shows, in schematic, cross-sectional view, an anchorage according to a second embodiment of the invention.
Figure 6:
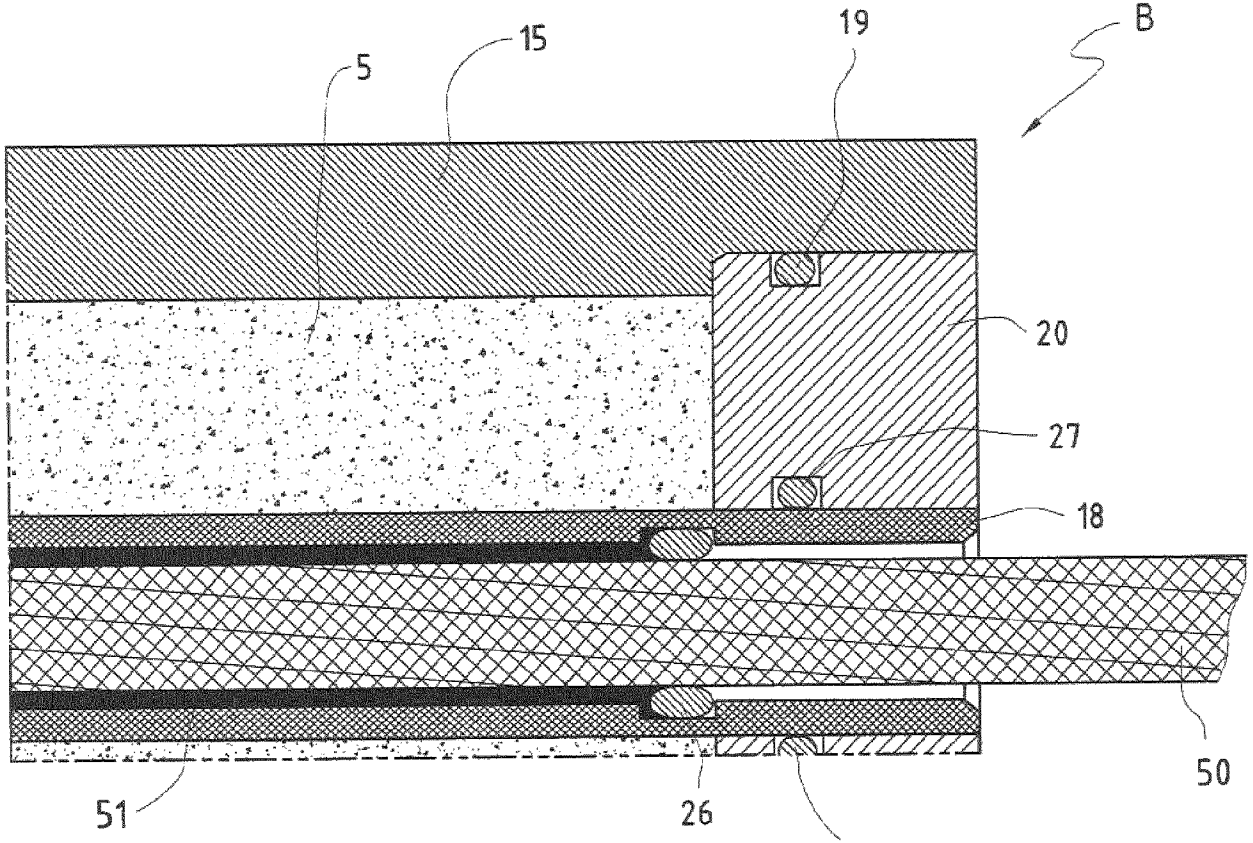
FIG. 6 shows an enlarged section (B) of the anchorage of FIG. 5.

A second embodiment is shown in FIGS. 5 and 6 which is similar to that of FIGS. 3 and 4, but with the addition of a transition pipe 15 and channel extension tubes 14, with appropriate adaptation of the orifice elements 18 and the anchor block 11. This example anchorage is longer than that of the first embodiment (for example longer than 150 mm), and is particularly suitable for use as an active end anchorage, where it is less crucial to minimise the overall length of the anchorage, since a certain minimum length is required in order carry out the strand tensioning or pre-stressing operation. The bedding region 54 can thus be longer, and the bedding effect can be distributed over a greater distance. The bedding cushion 51 may be such that the diminution gradient (see FIG. 2*d*) of the bending stresses over the bedding region 54 may be less steep than for the first embodiment. There may be. a gap (not shown) between the bedding cushion 51 and the strand 50 or the channel wall, for example, or the bedding material 51 may be less stiff or less hard than the bedding material used in the first embodiment.

Strands, particularly the strands of stay cables, are stripped of their polymer sheath in their end regions before the strands are inserted into the stressing-end anchorage channel 6. This is so that the wedges 12 can grip directly on to the bare steel of the strand, instead of the sheath. Enough sheath must be stripped such that, once the strand 50 has been pulled through the 10 channel 6 of the anchor block 11 at the stressing end, and fully tensioned, the end of the sheath is located somewhere between the anchoring region 56 and the inner seal 26 of the orifice element 18. The stressing end anchorage is thus required to be longer than the passive end anchorage, to allow for axial movement of the strand during tensioning. In this case, the channel in the anchor block is effectively extended by means of the channel extension tubes, 14, which are enclosed in a rigid structure such as solid grout, concrete or other hard filling material 5. The transition tube 15 is rigid enough to bear the transverse loads caused by the cable deviation and transferred either by a hard filling material or for example a back plate 20 secured substantially rigidly at the exit region 3 of the anchorage. As with the passive end anchorage, the space between the strand 50 and the inner wall of the (extended) channel is at least partially filled with a bedding material 51, preferably over a majority of the length of the anchor block 11 and with or without a gap between the bedding material and the strand, or between the bedding material and the channel wall. The bedding material 51 may advantageously also extend through the rest of the strand-channel to the inner seal 26 of the orifice element 18. Since most of the transverse loads caused by the cable deviation will be transferred to the transition pipe near the exit region of the anchorage, at a larger distance from the anchor block in this case, the transition pipe 15 must be rigid enough, and secured to the anchor block strongly enough, such that the forces are transmitted by the transition pipe 15 to the anchor block 11. To this end, a threaded joint 16 has been proposed, preferably using a rounded thread in order to minimize fracture points, between the transition pipe 15 and the anchor block 11. An adjustment ring 10 is also provided on the outer periphery of the anchor block 11, for fine adjustment of the axial position of the anchor block 11 against the structure 4 which cannot be provided by the wedges.

FIG. 6 shows how the orifice element 18 is arranged with inner 26 and outer 27 seals, for example in a back plate 20 or other element, sealed to the transition tube 15 with a seal such as an O-ring 19. The orifice element 18 is also extended to accommodate the tight-fit channel extension tube 14. Bedding material 51 is introduced into the space between the strand 50 and the inner wall of the channel/extension tubes 14, with or without a radial gap. The extension tubes 14 and/or the strand sheaths themselves may also form part of the bedding material 51/bedding cushion, in order to provide the required stiffness of the elastic/flexural bedding material between the strand 50 and the substantially rigid surrounding structure (in this case the grout/concrete/filler 5). The orifice element 18 may also be constructed as an elastic-walled piece, and may thus contribute to the elastic bedding near the exit region 3 if required. The strand channel 6 radially extends up to the rigid surrounding structure (in this case the grout/concrete/filler 5) and accommodates the bedding cushion, i.e the bedding material 51, the orifice element 18 and also possible channel extension tube 14: the diameter of strand channel 6 is therefore possibly not the same along its length.

The examples and embodiments described above have been illustrated with examples of anchorages which comprise straight strand channels 6, parallel to the longitudinal axis 9 of the cable 50 and to each other. However, the invention may be used in anchorages in which some or all of the channels are not straight, and/or not parallel to each other, and/or not parallel to the longitudinal axis 9 of the cable 50. The elastic bedding cushion 51 described above may be used, for example, in an anchorage in which the strand-channels 6 of the anchorage are curved and/or converge towards the free-running portion 53 of the cable 50.

In the previous text, the cable anchorage was illustrated in a non-limitative way in relation with a stay cable which anchorage was performed at its free end contained in the second channel end 6 by means of strand-anchoring device such as conical wedges 12: Therefore, the present invention can also be applied to another type of anchorage of the stay cables, namely an anchorage at a portion of the stay cable remote from its free ends. When using a cable deviation saddle, under some circumstances, there is no possible displacement of portion of the strand located at the central portion of the saddle, which situation therefore corresponds to an anchorage with the saddle forming a strand-anchoring device equivalent to the conical wedge 12. This situation corresponds to WO2011116828 in which a bedding material 51 can be used in replacement of the usual material for protecting strands against corrosion of the strands in the saddle body.

According to a possible variant, the filling is carried out such that the bedding region 54 extends axially along a single, substantially continuous portion of the axial length of the strand-channel 6. Alternatively, the filling is carried out such that the bedding region 54 comprises two or more discontinuous portions of the axial length of the strand-channel 6. Also, preferably, the filling is carried out such that axial length of the continuous portion of said bedding region 54, or the sum of the axial lengths of the discontinuous portions of said bedding region 54, is greater than half the axial length of the strand channel 6. In a preferred variant, the filling is carried out such that the bedding region 54 extends axially along substantially the entire axial length 55 of the strand-channel 6. Preferably, the filling is carried out such that the bedding cushion at least partially fills the radial separation distance between the outer surface of the strand 50 in the strand-channel 6 and a substantially rigid wall of the strand-channel 6, at least in the bedding region 54. In a preferred variant, the filling is carried out such that the bedding cushion substantially fills the radial separation distance at least over the axial length of the bedding region 54. Preferably, the filling step comprises introducing a liquid into the said space, which liquid then hardens to form the bedding material 51. Preferably, the liquid has a Brookfield dynamic viscosity of less than 25 poises and preferably less 10 than poises.

Also in a preferred embodiment, the strand-anchoring wedge 12 comprises one or more openings, and the filling step comprises introducing the bedding material 51 into the space through the openings. In a variant, the predetermined durometer of the bedding material 51 varies along the bedding region 54. In a variant, the predetermined stiffness of the bedding material 51 varies along the bedding region 54. Preferably, the variation in stiffness is achieved by a variation in the thickness of the bedding cushion and/or in the durometer of the bedding material 51 along the axial length of the bedding region 54.

Preferably, the method also comprising a sealing step, in which a seal 26 is provided between the outer surface of the strand and the inner surface of the strand-channel 6, and at a predetermined axial position along the strand-channel 6, in an annular or cylindrical recessed region of the inner wall of the channel 6, so as to prevent an axial movement of the bedding material 51, at least while the bedding material 51 is being introduced into the strand-channel 6, beyond the predetermined axial position in the direction of a main running portion B of the strand. Preferably, the seal 26 is configured to prevent ingress of moisture into the strand-channel 6 from a second end 3 of the strand-channel 6 remote from the strand-anchoring conical wedges 12.

In a variant, the filling step comprises an evacuation step of at least partially evacuating the space before and/or while introducing the bedding material 51. Preferably, the filling step comprises a testing step of testing the leak-tightness of the seal 26. Also, preferably, the cable anchorage comprises a strand-channel extension element 14 for providing an extension of the axial length, of the strand-channel 6 outside the anchor block 11 in a direction towards the main running portion 8.

In a variant, the cable anchorage comprises a plurality of the strand-channels 6, and the method comprises performing the filling, evacuating and/or testing steps on one or more of a plurality of strands 50 in one or more of the strand-channels 6 individually. In a variant, the method comprises an installation step of installing the strand 50 in the strand-channel 6. Preferably, a removal step, is performed before the installation step, of removing a previously-installed strand from the strand-channel 6. Preferably, the cable anchorage has one or more evacuation orifices for connection to a vacuum line for evacuating the said volume.

Preferably, the cable anchorage 1 comprises a transition region 2 extending axially between the anchor block 11 and a strand exit region 3, and a strand-channel extension element 14 for providing an extension of the axial length of the strand-channel 6 through the transition region 2. Also, preferably, the cable anchorage comprises a plurality of the strand-channels.

Preferably, the length 54 of the bedding region 54 is at least 90 mm, and preferably at least 150 mm.

REFERENCE NUMBERS USED ON THE FIGURES

1 Anchoring end
3 Exit end
4 Part of the structure

5 Hard filling material
6 Strand-channel
7 Longitudinal axis of the cable
8 Cable
9 Longitudinal axis of the strand-channel
10 Adjustment ring
11 Anchor block
12 Anchoring device (conical wedges)
13 Collar or deviator
14 Channel extension tubes
15 Transition pipe
18 Orifice element
19 O-ring
20 Back plate
22 Peak value
23 Very small value
26 Inner seal
27 Outer seal
50 Strand
51 Bedding material
53 Free-running or main part of the strand
54 Bedding region
55 Axial length of the strand-channel
56 Gripping or anchoring region

The invention claimed is:

1. A method of anchoring a cable comprising individual strands subject to static and dynamic deflection in a cable anchorage, said strand defining a free end portion and a free-running portion, the cable anchorage comprising an anchor block, individual strand channels extending at least through said anchor block, said individual strand channels extending between an anchoring end and an exit end, and individual strand-anchoring conical wedges at said anchoring, end of the anchor block of each strand channel for gripping said free end portion of the strand, the cable anchorage transferring an axial tension load in the strand to the anchor block, the strand exiting from the cable anchorage at said exit end in the direction of said free-running portion of the strand, the length of the strand channel being less than 10 times the smallest diameter of the strand channel, the method comprising:

a filling step, in which a space surrounding the strand in the strand-channel is at least partially filled with a flexural and/or elastic bedding material having a durometer at 23° C. in the range 10 to 70 Shore, so as to form a bedding cushion extending substantially around the strand in the strand-channel and axially along a bedding region of the axial length of the strand-channel, wherein said bedding cushion is in contact with both said strand and said anchor block, said bedding cushion ensuring thereby a reduction of the bending stresses in each strand by absorbing bending stresses along said bedding region.

2. A method according to claim 1, wherein the filling is carried out such that axial length of the continuous portion of said bedding region, or the sum of the axial lengths of the discontinuous portions of said bedding region, is greater than half the axial length of the strand channel.

3. A method according to claim 1, wherein the filling is carried out such that the bedding region extends axially along substantially the entire axial length of the strand-channel.

4. A method according to claim 1, wherein the filling is carried out such that the bedding cushion at least partially fills the radial separation distance between the outer surface of the strand in the strand-channel and a substantially rigid wall of the strand-channel, at least in the bedding region.

5. A method according to claim 1, wherein the bedding material comprises a polymeric material, an elastomeric material or a polymeric elastomer.

6. A method according to claim 1, wherein the bedding material comprises a polyurethane, an epoxy-polyurethane or an epoxy polymer.

7. A method according to claim 1, wherein the filling step comprises introducing a liquid into the said space, which liquid then hardens to form the bedding material.

8. A method according to claim 7, wherein the liquid has a Brookfield dynamic viscosity of less than 25 poises and preferably less 10 than poises.

9. A method according to claim 1, wherein the durometer at 23° C. of said bedding material is in the range 10 to 30 Shore, preferably in the range 15 to 25 Shore.

10. A method according to claim 1, wherein the filling step comprises providing the bedding material in the form of a coating or sleeve around the strand in the bedding region.

11. A method according to claim 1, wherein the compressive stiffness of said bedding material is between 50 and 250 MPa.

12. A method according to claim 1, comprising a sealing step, in which a seal is provided between the outer surface of each strand and the inner surface of the corresponding strand-channel, and at a predetermined axial position along the strand-channel, in an annular or cylindrical recessed region of the inner wall of the channel, so as to prevent an axial movement of the bedding material, at least while the bedding material being introduced into the strand-channel, beyond the predetermined axial position in the direction of a main running portion (B) of the strand.

13. A method according to claim 1, wherein the cable anchorage comprises a plurality of the strand-channels, and wherein the method comprises performing the filling step, comprising an evacuating step and/or a leak-tightness testing step on one or more of a plurality of strands in one or more of the strand-channels individually.

14. A method according to claim 13, comprising further an installation step of installing a strand in the strand channel and said method comprising further a removal step, performed before said installation step, of removing a previously-installed strand from the strand-channel.

15. A method of anchoring a cable comprising individual strands subject to static and dynamic deflection in a cable anchorage, said strand defining a free end portion and a free-running portion, the cable anchorage comprising an anchor block, individual strand channels extending at least through said anchor block, said individual strand channels extending between an anchoring end and an exit end, and individual strand-anchoring conical wedges at said anchoring end of the anchor block of each strand channel for gripping said free end portion oldie strand, the cable anchorage transferring an axial tension load in the strand to the anchor block, the strand exiting from the cable anchorage at said exit end in the direction of said free-running portion of the strand, the length of the strand channel being less than 10 times the smallest diameter of the strand channel, the method comprising:

a filling step, in which a space surrounding the strand in the strand-channel is at least partially filled with a flexural and/or elastic bedding material, so as to form a bedding cushion extending substantially around the strand in the strand-channel and axially along a bedding region of the axial length of the strand-channel, wherein said bedding cushion is in contact with both said strand and said anchor block, said bedding cushion ensuring thereby a reduction of the bending stresses in each strand by absorbing bending stresses along said bedding region wherein the method comprising further, before said filling step, a sealing step, in which a seal element s provided between the outer surface of the strand and the inner surface of the strand-channel, and at a predetermined axial position along the strand-channel, in an annular or cylindrical recessed region of the inner wall of the channel, said seal element preventing an axial movement of the bedding material, at least while the bedding material is being introduced into the strand-channel beyond said recessed region in the direction of a main running portion of the strand.

* * * * *